US010436222B2

(12) United States Patent
Yamamoto et al.

(10) Patent No.: US 10,436,222 B2
(45) Date of Patent: Oct. 8, 2019

(54) FAN ATTACHMENT STRUCTURE

(71) Applicant: JAPAN CLIMATE SYSTEMS CORPORATION, Hiroshima (JP)

(72) Inventors: Takehiro Yamamoto, Hiroshima (JP); Kazumi Fujimoto, Hiroshima (JP); Yosuke Harada, Hiroshima (JP)

(73) Assignee: Japan Climate Systems Corporation, Hiroshima (JP)

( * ) Notice: Subject to any disclaimer, the term of this patent is extended or adjusted under 35 U.S.C. 154(b) by 323 days.

(21) Appl. No.: 15/399,050

(22) Filed: Jan. 5, 2017

(65) Prior Publication Data

US 2017/0114793 A1 Apr. 27, 2017

Related U.S. Application Data

(63) Continuation of application No. PCT/JP2015/003678, filed on Jul. 22, 2015.

(30) Foreign Application Priority Data

Aug. 4, 2014 (JP) ..... 2014-158390

(51) Int. Cl.

| | |
|---|---|
| ***F04D 29/62*** | (2006.01) |
| ***F04D 29/20*** | (2006.01) |
| ***F04D 29/02*** | (2006.01) |
| ***F04D 29/053*** | (2006.01) |
| ***F04D 29/26*** | (2006.01) |
| ***F04D 29/28*** | (2006.01) |

(52) U.S. Cl.

CPC ..... *F04D 29/626* (2013.01); *F04D 29/023* (2013.01); *F04D 29/053* (2013.01); *F04D 29/20* (2013.01); *F04D 29/263* (2013.01); *F04D 29/283* (2013.01)

(58) Field of Classification Search

CPC ..... F16D 1/06; F04D 29/263; F04D 29/266; F04D 29/626; F02D 29/20

USPC ..... 416/134 R, 178

See application file for complete search history.

(56) References Cited

U.S. PATENT DOCUMENTS 2,882,077 A 4/1959 Marsh
2,974,502 A * 3/1961 Radcliffe ..... F04D 29/263 403/268

(Continued)

FOREIGN PATENT DOCUMENTS

DE 2720408 A1 * 10/1978 ..... F02D 29/263
GB 2142120 * 6/1983

(Continued)

OTHER PUBLICATIONS

International Search Report for corresponding International Application No. PCT/JP2015/003678 dated Oct. 27, 2015.

*Primary Examiner* — Lindsay M Low
*Assistant Examiner* — Robert A Werner
(74) *Attorney, Agent, or Firm* — Renner, Otto, Boisselle & Sklar, LLP

(57) ABSTRACT

A round bar output shaft is provided and fitted into an anti-slip member so as to rotate integrally with the anti-slip member. A recess is formed on the anti-slip member to make the stress generated on the anti-slip member by the output shaft fitted in non-uniform around a periphery of the anti-slip member. While the anti-slip member is being molded, a weld line is formed in a low-stress-generating portion.

1 Claim, 10 Drawing Sheets

(56) References Cited

U.S. PATENT DOCUMENTS

| | | | | |
|---|---|---|---|---|
| 3,307,634 | A * | 3/1967 | Bihlmire | B63H 1/20 416/135 |
| 5,871,335 | A * | 2/1999 | Bartlett | F04D 29/263 403/349 |
| 2003/0180165 | A1* | 9/2003 | Motomura | F04D 29/263 417/423.12 |
| 2016/0230813 | A1* | 8/2016 | Griffiths | F16D 1/06 |
| 2017/0107997 | A1* | 4/2017 | Yamamoto | B60H 1/00 |

FOREIGN PATENT DOCUMENTS

| | | | |
|---|---|---|---|
| GB | 2 142 120 | A | 1/1985 |
| JP | 11-343997 | A | 12/1999 |
| JP | 2004225545 | * | 1/2003 |
| JP | 2005054722 | * | 8/2003 |
| JP | 4385679 | B2 | 10/2009 |

* cited by examiner

FAN ATTACHMENT STRUCTURE

CROSS-REFERENCE TO RELATED APPLICATION

This is a continuation of International Application No. PCT/JP2015/003678 filed on Jul. 22, 2015, which claims priority to Japanese Patent Application No. 2014-158390 filed on Aug. 4, 2014. The entire disclosures of these applications are hereby incorporated by reference.

BACKGROUND

The present disclosure relates to a fan attachment structure provided for a blower unit of a vehicle air conditioner, for example.

Vehicle air conditioners are generally provided with a blower unit for supplying air-conditioning air to a heat exchanger (see, for example, Japanese Unexamined Patent Publication No. 11-343997). Such a blower unit includes a centrifugal fan, a fan housing to house the fan, and a motor to drive the fan. The motor has a metallic output shaft, which has a D-cross section by having its peripheral surface partially cut off. The fan is a resin molded product, and includes, at the center of rotation thereof, a cylindrical insert member to which the output shaft of the motor is fitted. The insert member is made of a resin material having higher mechanical strength than the resin material that forms the body of the fan.

A motor output shaft with a D-cross section such as the one disclosed in Japanese Unexamined Patent Publication No. 11-343997 certainly functions as an anti-slip in the rotational direction, but is difficult to balance its rotation by itself, which is not beneficial. In addition, the hardness of the metallic output shaft requires a non-negligible cost for partially cutting off the output shaft into a desired D-cross section.

To avoid these disadvantages, the motor may have a round bar output shaft with a circular cross section so as to have its rotation balanced easily and to be formed at a reduced machining cost. A round bar output shaft, however, is no longer engageable with the insert member in its rotational direction when fitted into the insert member, and will slip more easily in the rotational direction with respect to the insert member when rotating, thus possibly allowing relative rotations. The output shaft may be prevented from slipping if the entire fan is molded of a resin material with high mechanical strength with the insert member omitted, for example. However, this method results in an increased material cost and/or molding cost for the fan.

Another possibility may be more tightly fitting the output shaft into the insert member either by increasing the outer diameter of the output shaft or by decreasing the inner diameter of the insert member in which the output shaft is fitted. In that case, the round bar output shaft will generate a high stress substantially uniformly over the entire periphery of the insert member. In this structure, the insert member has been formed by molding a resin material, and therefore, has a weld line formed in a portion thereof where molten resin flows have merged with each other in the die during the molding process. A portion of the insert member with such a weld line is more vulnerable to the stress than the rest of the insert member. As described above, the stress is generated substantially uniformly over the entire periphery of the insert member by the output shaft fitted in. Thus, there is a concern about the insert member's cracking eventually, no matter where a weld line has been formed around the periphery.

It is therefore an object of the present disclosure to prevent a cylindrical anti-slip member of a resin material from cracking when a round bar motor output shaft is fitted into the anti-slip member.

SUMMARY

To achieve this object, the present disclosure allows stress to be generated non-uniformly around the periphery of the resin anti-slip member such that a weld line is formed in a portion not to be subjected to a high stress.

A first aspect of the present disclosure is a fan attachment structure for attaching a fan to an output shaft of a fan drive motor.

The fan includes: a fan body made of a resin and including impellers and a central cylindrical portion provided at a center of rotation thereof; and a cylindrical anti-slip member configured to be secured to the fan body by being inserted into the central cylindrical portion and to rotate integrally with the fan body. The anti-slip member has been injection-molded out of a resin.

The output shaft is configured as a round bar and fitted into the anti-slip member so as to rotate integrally with the anti-slip member.

The anti-slip member has a recess to make stress to be generated on the anti-slip member by the output shaft fitted non-uniform around a periphery of the anti-slip member, and also has a high-stress-generating portion and a low-stress-generating portion where the stress generated is lower than in the high-stress-generating portion.

While the anti-slip member is being molded, a weld line is formed in the low-stress-generating portion.

According to this configuration, the recess makes the stress generated on the anti-slip member non-uniform, thus causing the anti-slip member to have a high-stress-generating portion and a low-stress-generating portion. In addition, since a weld line is formed in the low-stress-generating portion, that portion of the anti-slip member with the weld line may be prevented from cracking.

A second aspect of the present disclosure is an embodiment of the first aspect. In the second aspect, the recess is formed on an outer peripheral surface of the anti-slip member.

According to this configuration, the recess formed on the outer peripheral surface of the anti-slip member eliminates the need for forming any recess on the inner peripheral surface of the anti-slip member. This allows the output shaft to be fitted into the anti-slip member reliably.

According to the first aspect of the present disclosure, the stress to be generated on the anti-slip member by fitting the output shaft of a fan drive motor may be distributed non-uniformly around the periphery of the anti-slip member, and a weld line is formed in the low-stress-generating portion of the anti-slip member. This may prevent the anti-slip member from cracking.

According to the second aspect of the present disclosure, no recesses need to be formed on the inner peripheral surface of the anti-slip member, which thus allows the output shaft to be fitted with reliability.

DETAILED DESCRIPTION

Embodiments of the present disclosure will now be described in detail with reference to the accompanying drawings. Note that the following description of embodiments is only an example in nature and is not intended to limit the scope, application, or uses of the present disclosure.

Figure 1:
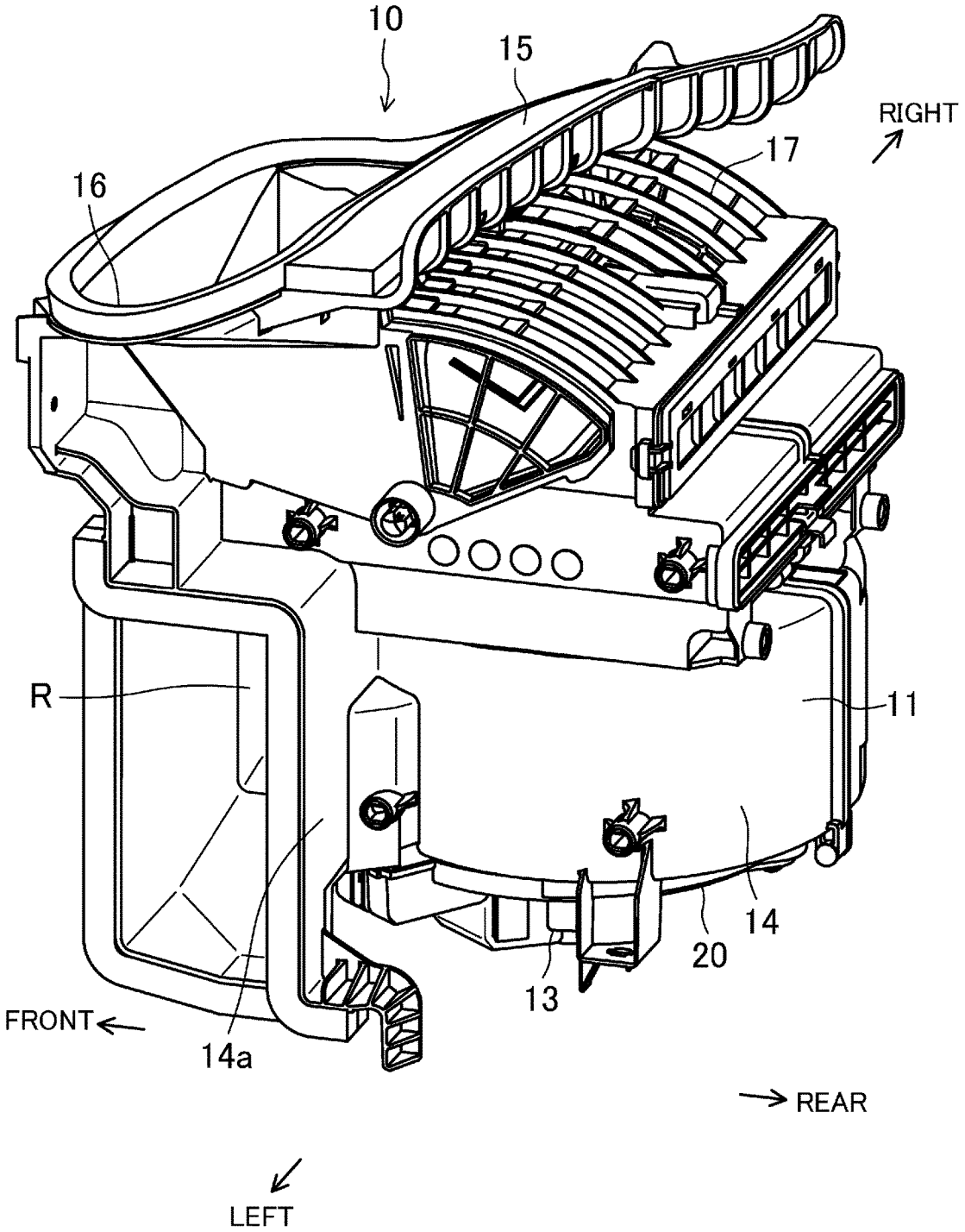
FIG. 1 is a perspective view of a blower unit according to an embodiment of the present disclosure.

FIG. 1 illustrates a blower unit 10 to which a fan attachment structure according to an embodiment of the present disclosure is applied. This blower unit 10 forms part of a vehicle air conditioner (not shown) installed in an automobile, for example. The vehicle air conditioner includes an air-conditioning unit (not shown) with a cooling heat exchanger and a heating heat exchanger, as well as the blower unit 10. The blower unit 10 is configured to supply air-conditioning air to the air-conditioning unit. The air-conditioning unit is configured to adjust the temperature of the air-conditioning air supplied from the blower unit 10 and then supply the air to respective parts of the vehicle cabin. The blower unit 10 and the air-conditioning unit are installed inside an instrument panel (not shown) arranged at a frontend of the vehicle cabin.

In the following description of embodiments, the present disclosure will be described as being applied to a so-called "semi-center unit" in which the air-conditioning unit of the vehicle air conditioner is arranged around a center in the vehicle width direction and the blower unit 10 is arranged on the passenger seat side. However, the present disclosure is applicable to not only such a "semi-center unit" but also a "full-center unit" in which the heat exchangers and the blower fan are aggregated around the center in the vehicle width direction. Substantially the same fan attachment structure is applicable to these semi-center and full-center units. Also, in this exemplary embodiment, the blower unit 10 is designed for a left-hand drive vehicle, of which the passenger seat is provided on the right side thereof, and therefore, is arranged on the right side of the vehicle.

In the following description of embodiments, the front side of the vehicle will be hereinafter simply referred to as "front," the rear side thereof "rear," the left side thereof "left," and the right side thereof "right."

The blower unit 10 includes a blower casing 11, a blower fan 12 housed in the blower casing 11, and a fan drive motor 13 to drive the blower fan 12. The blower casing 11 is comprised of a plurality of resin parts separable in the horizontal direction. Under the blower casing 11, provided is a fan housing 14 in which the blower fan 12 is housed. Inside the fan housing 14, an air outflow passage R is defined to surround the blower fan 12.

Over the blower casing 10, provided is a fresh/recirculation air switching portion 15. A fresh air inlet 16 is open at the frontend of the fresh/recirculation air switching portion 15. Although not shown, the fresh air inlet 16 communicates with the exterior of the vehicle cabin through a fresh-air-introducing duct. A recirculation air inlet 17 is open at the rear end of the fresh/recirculation air switching portion 15, and communicates with the interior of the vehicle cabin. Although not shown, a fresh/recirculation air switching damper is provided inside the fresh/recirculation air switching portion 15. The fresh/recirculation air switching damper allows the user to open one of the fresh and recirculation air inlets 16 and 17 and close the other.

The fan housing 14 has a cylindrical shape as a whole. A duct portion 14*a* is provided for a left wall portion at the frontend of the fan housing 14. The duct portion 14*a* forms a downstream end portion of the air outflow passage R and is connected to the air-conditioning unit.

Figure 2:
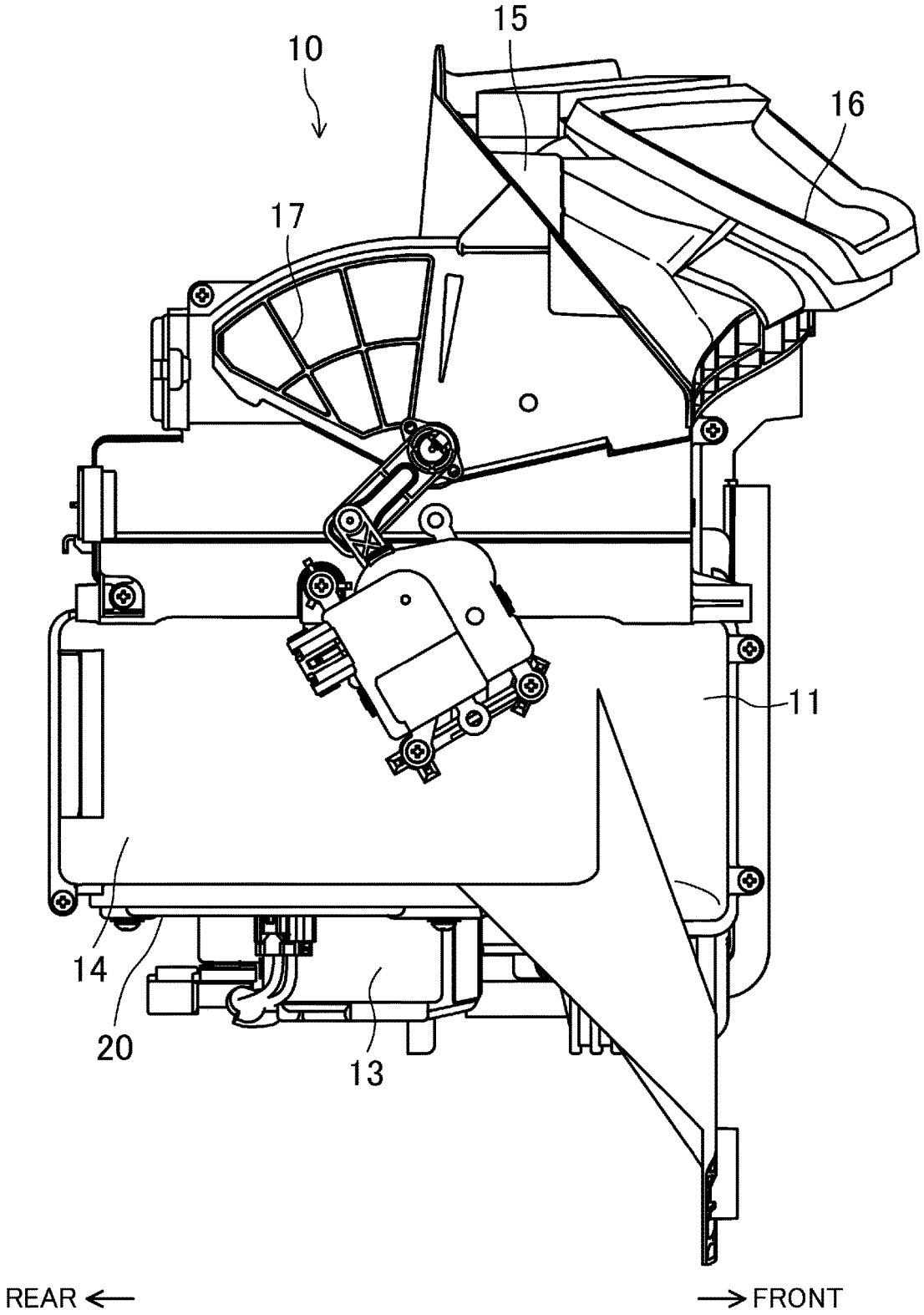
FIG. 2 is a right side view of the blower unit.

The bottom wall portion of the fan housing 14 has an insertion hole (not shown) through which the blower fan 12 is inserted into the fan housing 14 while being mounted to this blower unit 10. This insertion hole is closed with a circular plate 20, which is attachable to, and removable from, the bottom wall portion of the fan housing 14. The circular plate 20 is provided with a fan drive motor 13, which may have a conventional known structure. As shown in FIG. 2, the body portion of the fan drive motor 13 is provided so as to protrude both upward and downward with respect to the circular plate 20.

Figure 3:
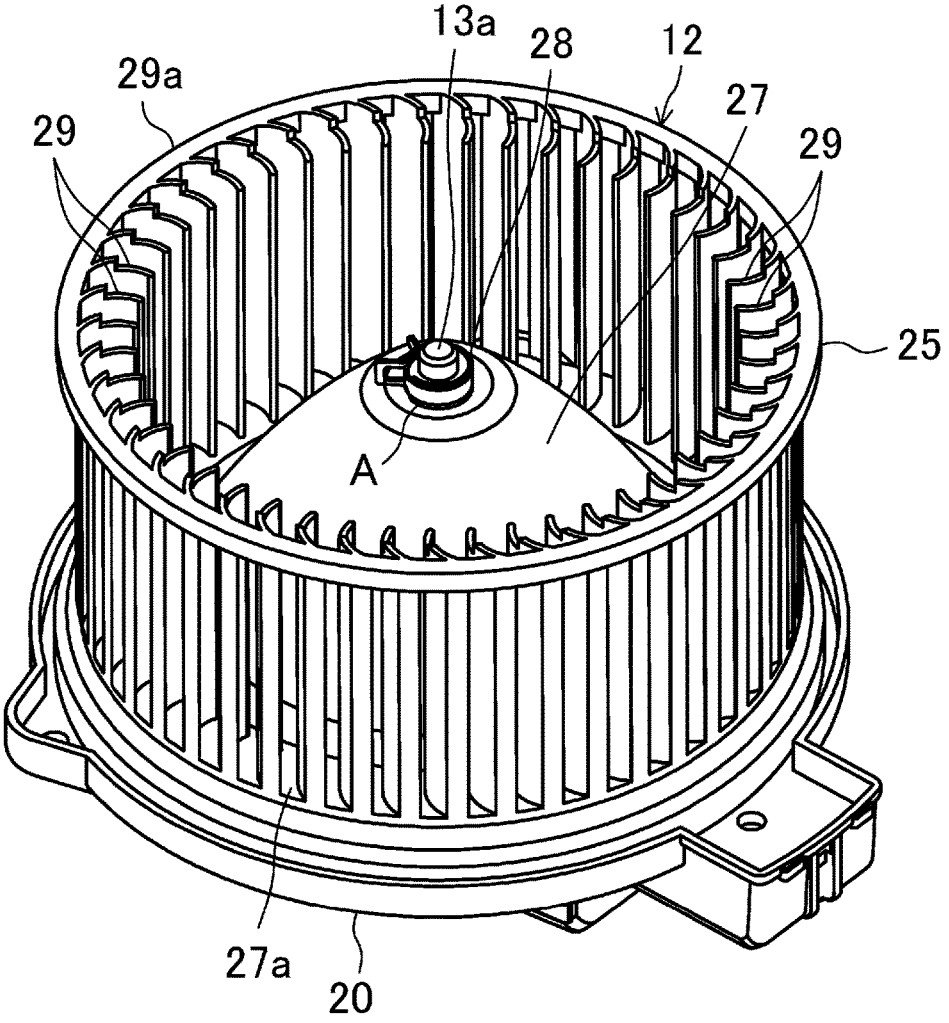
FIG. 3 is a perspective view of a fan mounted on the output shaft of a motor as viewed from above the fan.
Figure 4:
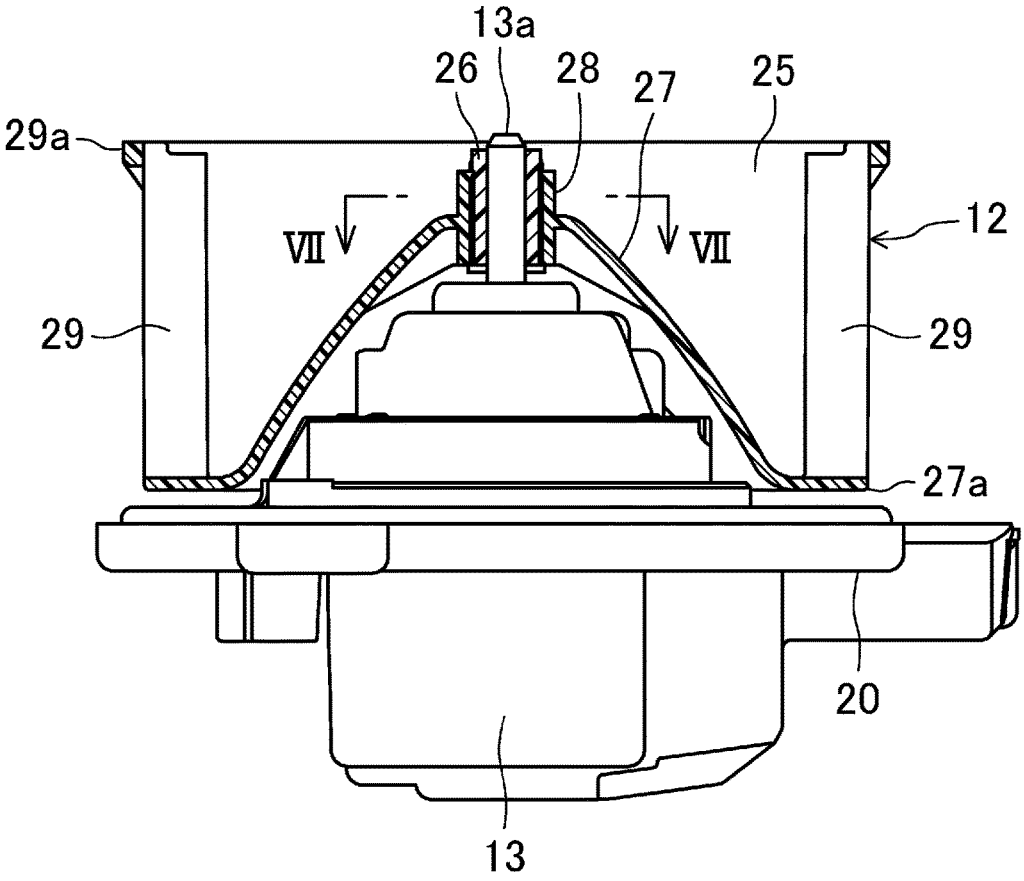
FIG. 4 is a cross-sectional view of the fan mounted on the output shaft of the motor.

As shown in FIGS. 3 and 4, the output shaft 13*a* of the fan drive motor 13 protrudes upward from the body of the fan drive motor 13. This output shaft 13*a* is arranged approximately at the center inside the fan housing 14. The output shaft 13*a* is implemented as a metallic round bar and has a generally circular cross section throughout the portion thereof that protrudes upward from the body of the fan drive motor 13.

Figure 14:
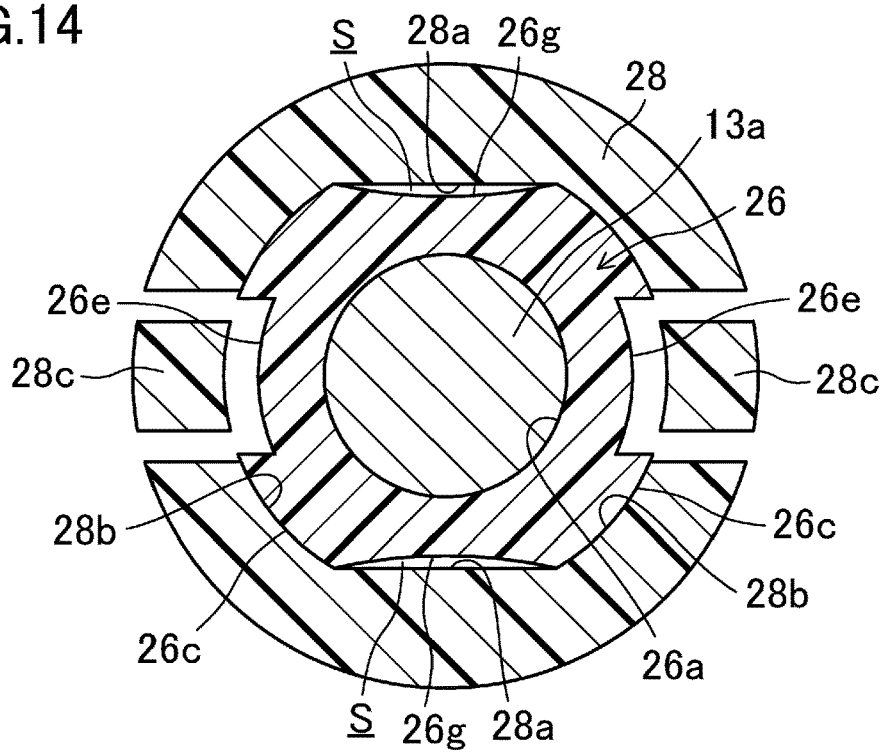
FIG. 14 illustrates a first variation of the embodiment and corresponds to FIG. 7.

As shown in FIG. 3, the blower fan 12 is a centrifugal fan (sirocco fan), and is configured to blow out the air sucked from over the blower fan 12 into the air outflow passage R of the fan housing 14 through the periphery of the blower fan 12. As shown in FIG. 14, the blower fan 12 includes a fan body 25 and an anti-slip member 26. The fan body 25 may be an injection molded product of a resin material such as polypropylene, and includes a conic portion 27, a central cylindrical portion 28 provided at the center of the conic portion 27 (i.e., the center of rotation), and a large number of impellers 29, 29, . . . . The conic portion 27, central cylindrical portion 28, and impellers 29 have been molded integrally.

The conic portion 27 of the fan body 25 has a curved shape overall such that a portion thereof around the center of rotation of the fan body 25 is located at the top and that the other portion thereof slopes radially downward and outward from the center of rotation toward the outer peripheral edge thereof. The radially outer peripheral portion of the conic portion 27 is located in the vicinity of the upper surface of the circular plate 20, and extends radially to define an annular extended portion 27*a* that runs continuously in the circumferential direction.

Figure 5:
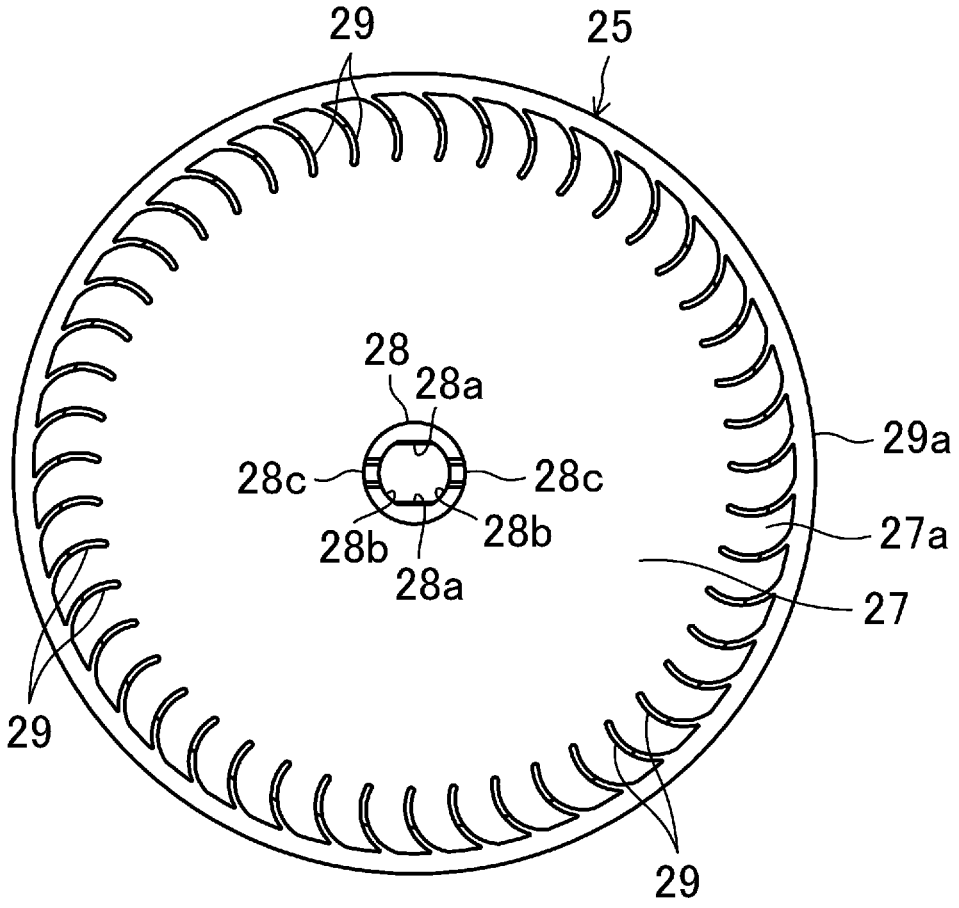
FIG. 5 is a plan view of its fan body.
Figure 6:
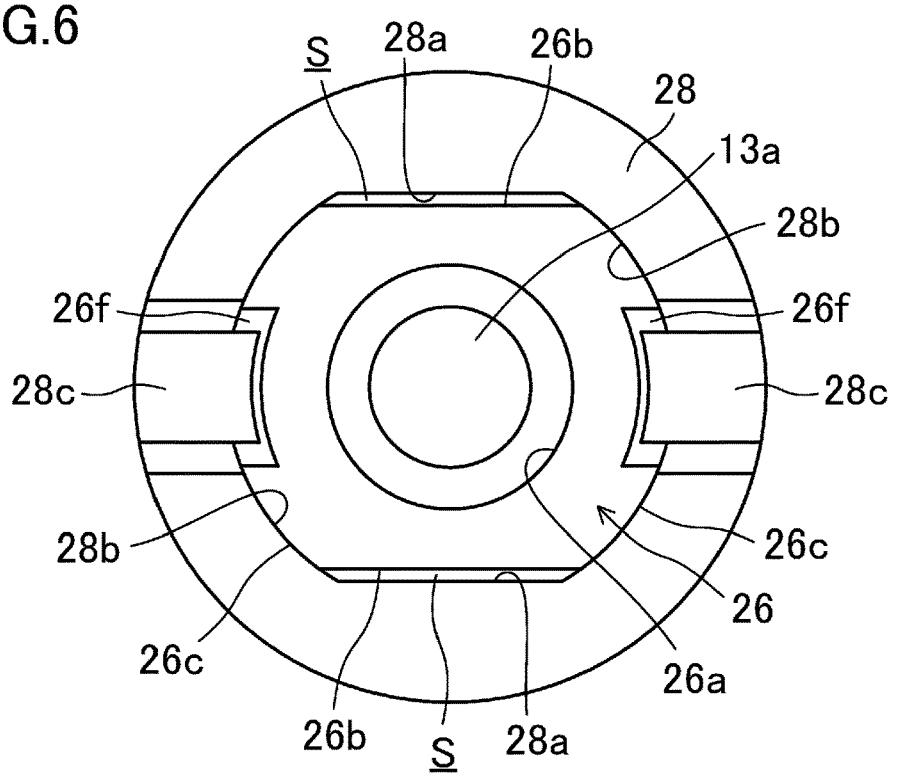
FIG. 6 is a plan view illustrating, on a larger scale, a center of rotation portion of the fan.
Figure 7:
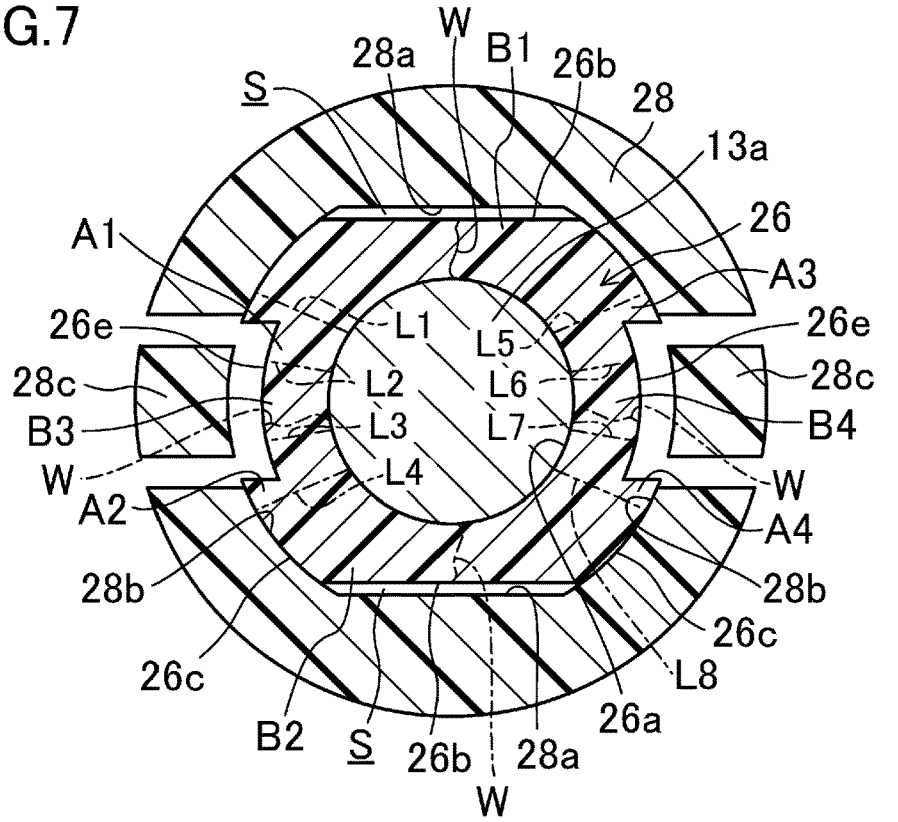
FIG. 7 is a cross-sectional view taken along the plane VII-VII shown in FIG. 4.

The central cylindrical portion 28 of the fan body 25 extends vertically upward and downward, and has openings at the top and bottom thereof. As shown in FIGS. 5-7, the inner peripheral surface of the central cylindrical portion 28 has two fan's flat surfaces 28*a*, 28*a* and two fan's circular arc surfaces 28*b*, 28*b*, which are arranged alternately along the circumference of the central cylindrical portion 28. The fan's flat surfaces 28*a*, 28*a* extend along the centerline of the central cylindrical portion 28 and are arranged so as to radially face each other. The radial distance from one fan's flat surface 28*a* to the centerline of the central cylindrical portion 28 is equal to the radial distance from the other fan's flat surface 28*a* to the centerline of the central cylindrical portion 28. The fan's circular arc surfaces 28*b*, 28*b* have a circular arc shape, of which the center agrees with the centerline of the central cylindrical portion 28, and are arranged so as to face each other.

In addition, at the top of the central cylindrical portion 28 of the fan body 25, provided are two flexible pieces 28*c*, 28*c*, which are located at the fan's circular arc surfaces 28*b*, 28*b* of the central cylindrical portion 28. The flexible pieces 28*c* are made of a flexible resin material and are flexibly deformable overall such that their upper end portion is radially displaceable with respect to the central cylindrical portion 28. Also, as shown in FIG. 3, a clamping fitting A to clamp the central cylindrical portion 28 is provided over the central cylindrical portion 28.

As shown in FIGS. 3 and 4, the impellers 29 have been molded to form integral parts of the upper surface of the annular extended portion 27*a* and to extend upward from the upper surface. Between each pair of impellers 29, a gap is left to allow the air to flow therethrough. At the top of the impellers 29, provided is an annular coupling portion 29*a* extending in the circumferential direction. The top of every impeller 29, 29, . . . is connected to the coupling portion 29*a*.

Figure 8:
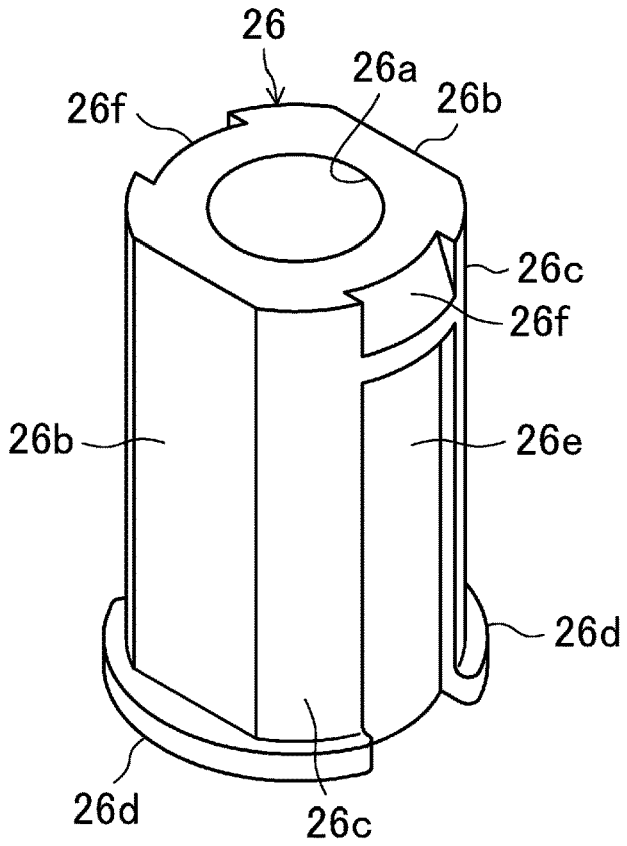
FIG. 8 is a perspective view of an anti-slip member as viewed from above it.
Figure 9:
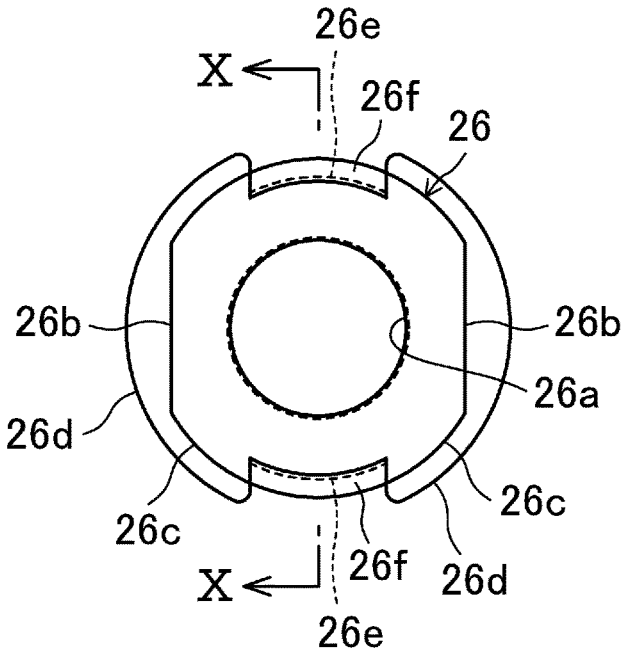
FIG. 9 is a plan view of the anti-slip member.
Figure 10:
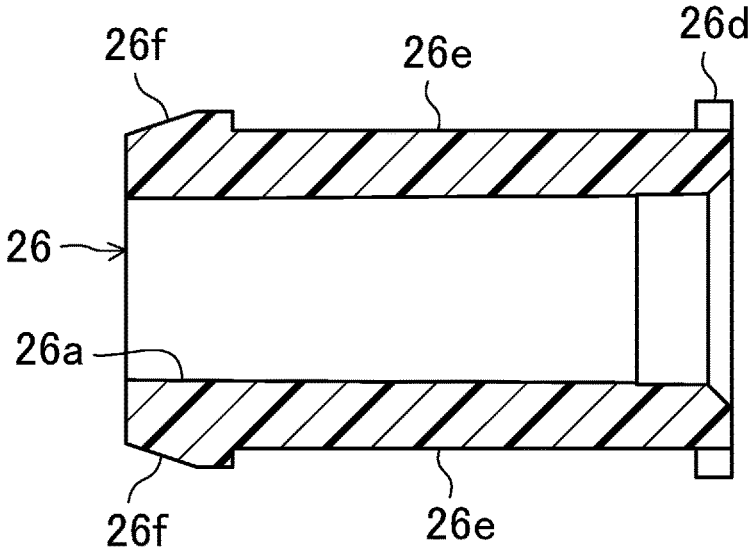
FIG. 10 is a cross-sectional view taken along the plane X-X shown in FIG. 9.
Figure 11:
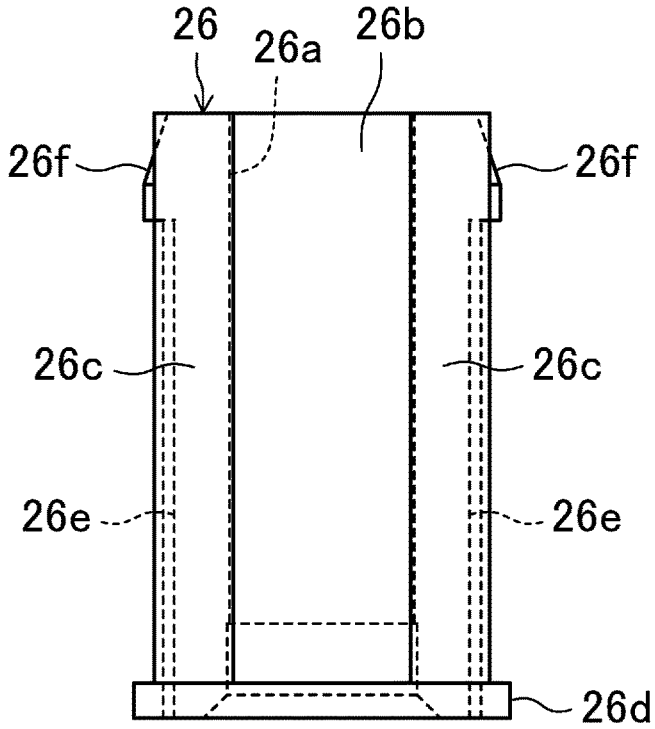
FIG. 11 is a side view of the anti-slip member as viewed from beside one of the flat surfaces thereof.
Figure 12:
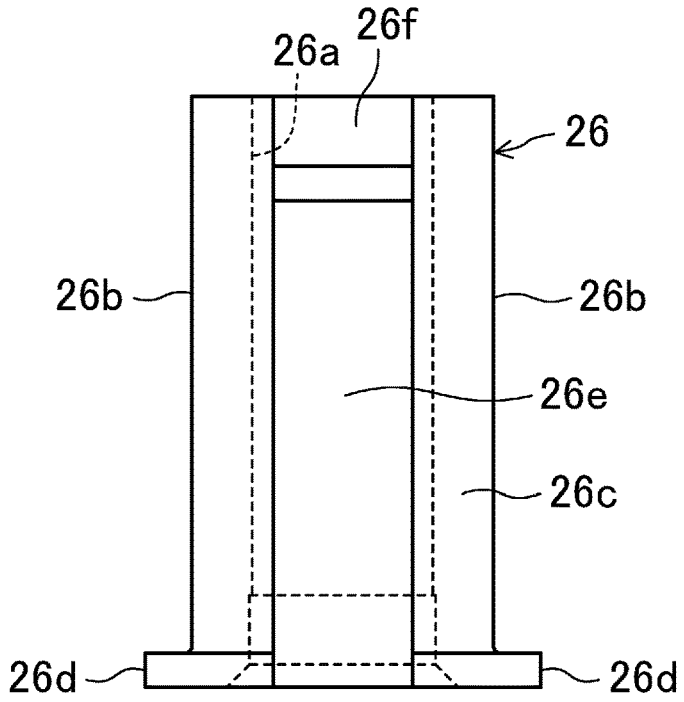
FIG. 12 is a side view of the anti-slip member as viewed from beside one of the recesses thereof.
Figure 13:
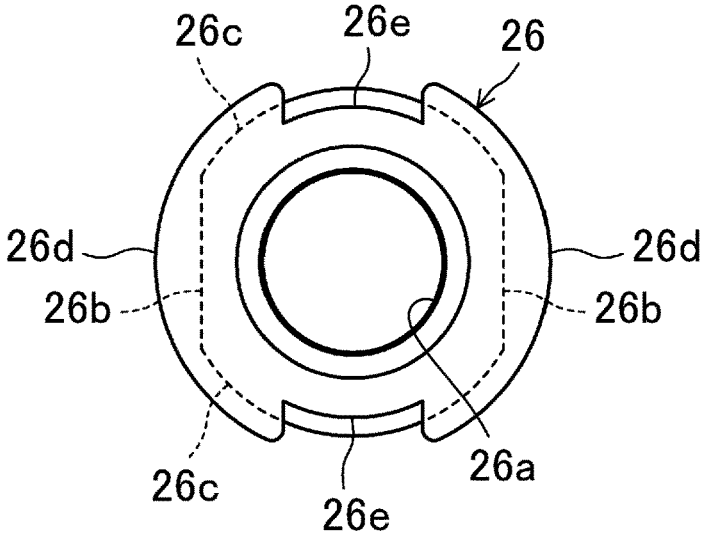
FIG. 13 is bottom view of the anti-slip member.

The anti-slip member 26 is formed by molding a resin material having higher mechanical strength (such as tensile strength or flexural strength) than the resin material of the fan body 25 into a cylindrical shape. The anti-slip member 26 is secured to the fan body 25 so as to be inserted into the central cylindrical portion 28 of the fan body 25. As shown in FIGS. 8-10, the center of the anti-slip member 26 is a shaft hole 26*a* to which the output shaft 13*a* of the motor 13 is fitted. The inner diameter of the shaft hole 26*a* is set to be a little smaller than the outer diameter of the output shaft 13*a* of the motor 13. Specifically, the output shaft 13*a* of the motor 13 is fitted into the shaft hole 26*a* of the anti-slip member 26 with such contact force as to prevent the output shaft 13*a* from slipping in the rotational direction with respect to the anti-slip member 26 when the motor 13 is started up with the output shaft 13*a* fitted into the shaft hole 26*a*. This fitting slightly increases the outer diameter of the anti-slip member 26. In this exemplary embodiment, the anti-slip member 26 is made of a resin material with high mechanical strength, and therefore, the output shaft 13*a* fitted into the shaft hole 26*a* of the anti-slip member 26 may be prevented for a long period of time from slipping in the rotational direction. In addition, not the entire blower fan 12 but only the anti-slip member 26 is molded out of a resin material with high mechanical strength. This may cut down the material cost of the blower fan 12.

The outer peripheral surface of a portion of the anti-slip member 26 to be inserted into the central cylindrical portion 28 have two shaft's flat surfaces 26*b*, 26*b* and two shaft's circular arc surfaces 26*c*, 26*c*, which are arranged alternately in the circumferential direction. The shaft's flat surfaces 26*b*, 26*b* extend along the centerline of the anti-slip member 26. The anti-slip member 26 is inserted into the central cylindrical portion 28 of the fan body 25 such that the shaft's flat surfaces 26*b*, 26*b* respectively face their associated fan's flat surfaces 28*a*, 28*a* and that the shaft's circular arc surfaces 26*c*, 26*c* respectively contact with their associated fan's circular arc surfaces 28*b*, 28*b*. Providing the shaft's flat surfaces 26*b*, 26*b* for the anti-slip member 26 may prevent the anti-slip member 26 from rotating relative to the central cylindrical portion 28 of the fan body 25.

As shown in FIGS. 6 and 7, the shaft's flat surfaces 26*b*, 26*b* are arranged to be out of contact with their associated fan's flat surfaces 28*a*, 28*a* such that a gap S is left between each pair of shaft's and fan's flat surfaces 26*b*, 28*a* that face each other. The magnitude of the gap S between each pair of shaft's and fan's flat surfaces 26*b*, 28*a* is determined in advance so as not to go zero even when the anti-slip member 26 has its diameter increased by fitting the output shaft 13*a* of the motor 13 into the shaft hole 26*a* of the anti-slip member 26.

Also, flanges 26*d*, 26*d* are provided at the respective bottoms of the shaft's circular arc surfaces 26*c*, 26*c* of the anti-slip member 26. Each of these flanges 26*d* is provided to protrude radially outward from the range where its associated shaft's circular arc surface 26*c* is located. These flanges 26*d* are designed to abut with the bottom of the central cylindrical portion 28 of the fan body 25 when the anti-slip member 26 is inserted into the central cylindrical portion 28. This prevents the anti-slip member 26 from being accidentally drawn out upward from the central cylindrical portion 28.

As shown in FIGS. 7 and 8, a recess 26*e* is formed on each shaft's circular arc surface 26*c* of the anti-slip member 26. In a side view, each recess 26*e* has the shape of a rectangle extending upward from the bottom of its associated shaft's circular arc surface 26*c*. The top of each recess 26*e* is located under, and away from, the top of its associated shaft's circular arc surface 26*c*. Also, each recess 26*e* is located at the middle of its associated shaft's circular arc surface 26*c* in the circumferential direction. When the anti-slip member 26 is inserted into the central cylindrical portion 28 of the fan body 25, the portions with the recesses 26*e* are out of contact with the fan's circular arc surfaces 28*b*, 28*b* of the central cylindrical portion 28.

The presence of the recess 26*e* causes the stress generated on the anti-slip member 26 to vary from one location to another. Specifically, since the inner diameter of the shaft hole 26*a* of the anti-slip member 26 is set to be slightly smaller than the outer diameter of the output shaft 13*a* of the fan drive motor 13, stress is generated over the entire periphery of the anti-slip member 26 by the output shaft 13*a* of the fan drive motor 13 fitted in. In this embodiment, corners of each recess 26*e* are formed to have an acute-angled notched cross section, and therefore, the stress increases in areas covering and surrounding those corners of the recess 26*e*.

As shown in FIG. 7, those areas covering and surrounding the corners of the recesses 26*e* will be hereinafter referred to as an area A1 interposed between lines L1 and L2, an area A2 interposed between lines L3 and L4, an area A3 interposed between lines L5 and L6, and an area A4 interposed between lines L7 and L8. The other areas of the anti-slip member 26 will be hereinafter referred to as an area B1 interposed between lines L1 and L5, an area B2 interposed between lines L4 and L8, an area B3 interposed between lines L2 and L3, and an area B4 interposed between lines L6 and L7. In that case, the stress generated in the latter group of areas B1, B2, B3, and B4 becomes lower than the stress generated in the former group of areas A1, A2, A3, and A4. That is to say, the areas B1, B2, B3, and B4 function as low-stress-generating portions, while the areas A1, A2, A3, and A4 function as high-stress-generating portions.

The anti-slip member 26 is molded with a molten resin injected into the cavity of a die (not shown). As a result of this injection molding process, a weld line W is formed at a region where molten resin flows merge with each other. In this embodiment, the weld line W is located in the area B1 that is a low-stress-generating portion. Note that as indicated by a phantom line in FIG. 7, the weld line W could be located anywhere else but the areas A1, A2, A3, and A4, and may be located in the area B2, B3, or B4, for example.

In addition, as shown in FIG. 10, each shaft's circular arc surface 26*c* of the anti-slip member 26 also has a sloped surface 26*f* which is located over its associated recess 26*e*. The sloped surface 26*f* is sloped such that the closer to the top, the closer to the centerline of the anti-slip member 26. When the anti-slip member 26 is inserted into the central cylindrical portion 28 of the fan body 25, the flexible pieces 28*c*, 28*c* abut with the sloped surfaces 26*f*, 26*f*.

According to this exemplary embodiment, the inner peripheral surface of the central cylindrical portion 28 of the fan body 25 has fan's flat surfaces 28*a*, 28*a* and fan's circular arc surfaces 28*b*, 28*b*, and the outer peripheral surface of the anti-slip member 26 has shaft's flat surfaces 26*b*, 26*b* extending along the fan's flat surfaces 28*a*, 28*a* and shaft's circular arc surfaces 26*c*, 26*c* extending along the fan's circular arc surfaces 28*b*, 28*b*. This significantly reduces the relative rotations between the anti-slip member 26 and the fan body 25.

In addition, if the output shaft 13*a* of the motor 13 is fitted into the anti-slip member 26 that has been inserted into the central cylindrical portion 28 of the fan body 25, then the stress generated on the anti-slip member 26 will be distributed non-uniformly, which results in a lower stress in the areas B1, B2, B3, and B4. In this case, the weld line W is located in the area B1 with the lower stress. This thus prevents a portion of the anti-slip member 26 with the weld line W from cracking.

In addition, when the motor 13 is started up with its output shaft 13*a* fitted into the anti-slip member 26, the rotational force of the output shaft 13*a* is transmitted to the fan body 25 via the anti-slip member 26, thus rotating the fan body 25. In this case, the recesses 26*e*, 26*e* formed on the outer peripheral surface of the anti-slip member 26 reduce the contact force between the outer peripheral surface of the anti-slip member 26 and the inner peripheral surface of the central cylindrical portion 28 of the fan body 25, even when the output shaft 13*a* is fitted thereto. This reduces the vibrations propagated from the motor 13 to the fan body 25 via the output shaft 13*a* and the anti-slip member 26, thus resulting in a significantly reduced harsh noise.

Furthermore, the recesses 26*e*, 26*e* of the anti-slip member 26 extend along the centerline of the anti-slip member 26. Thus, the contact force produced by the outer peripheral surface of the anti-slip member 26 with respect to the inner peripheral surface of the central cylindrical portion 28 of the fan body 25 may be reduced in a broad range along the centerline of the anti-slip member 26. This further reduces the vibrations propagated to the fan body 25.

Moreover, the gap S left between each shaft's flat surface 26*b* of the anti-slip member 26 and its associated fan's flat surface 28*a* of the fan body 25 reduces the contact force produced by the outer peripheral surface of the anti-slip member 26 with respect to the inner peripheral surface of the central cylindrical portion 28 of the fan body 25, even after the output shaft 13*a* has been fitted. This reduces the vibrations propagated from the motor 13 to the fan body 25 via the output shaft 13*a* and the anti-slip member 26, thus resulting in a significantly reduced harsh noise.

As can be seen from the foregoing description, according to this embodiment, the weld line W is located in the area B1 that is one of the low-stress-generating portions of the anti-slip member 26, thus preventing the anti-slip member 26 from cracking. The same remarks apply to even a situation where the weld line W is located in the area B2, B3, or B4.

In the exemplary embodiment described above, the gap S is supposed to be left between each shaft's flat surface 26*b* of the anti-slip member 26 and its associated fan's flat surface 28*a* of the fan body 25. However, this is only a non-limiting exemplary embodiment. Optionally, the gap S may be eliminated, for example. In that case, each shaft's flat surface 26*b* of the anti-slip member 26 contacts with its associated fan's flat surface 28*a* of the fan body 25. However, the recesses 26*e*, 26*e* on the outer peripheral surface of the anti-slip member 26 may also reduce the contact force produced by the outer peripheral surface of the anti-slip member 26 with respect to the inner peripheral surface of the central cylindrical portion 28 of the fan body 25, even after the output shaft 13*a* has been fitted.

In the embodiment described above, the anti-slip member 26 has the shaft's flat surfaces 26*b*. However, this is only an example of the present disclosure. Alternatively, as in a first variation shown in FIG. 14, the anti-slip member 26 may also have a pair of shaft's curved surfaces 26*g*. Each of these shaft's curved surfaces 26*g* is curved away from its associated fan's flat surface 28*a* of the fan body 25 (i.e., toward the output shaft 13*a*), thus leaving a gap S between the shaft's curved surface 26*b* and the fan's flat surface 28*a*. Likewise, although not shown, each fan's flat surface 28*a* may be replaced with a curved surface which is curved away from the output shaft 13*a*.

Figure 15:
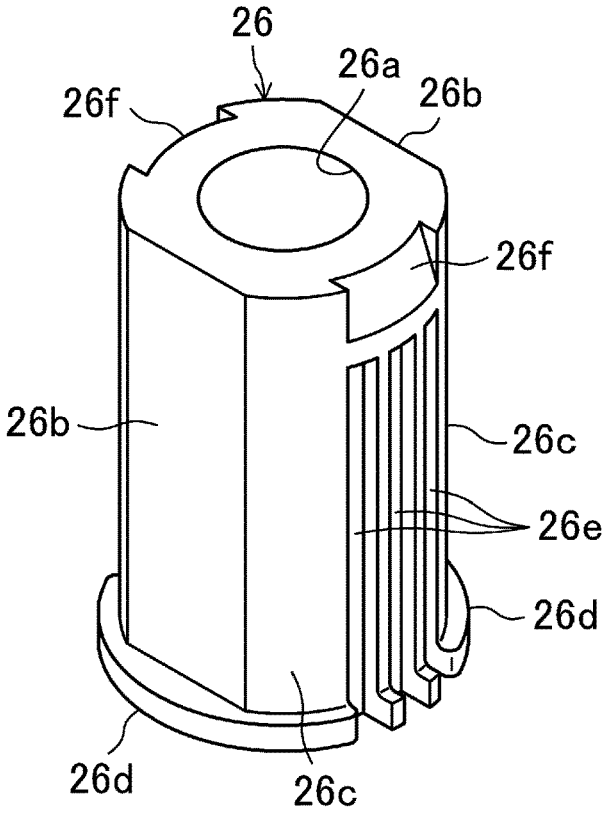
FIG. 15 illustrates a second variation of the embodiment and corresponds to FIG. 8.

Still alternatively, as in a second variation shown in FIG. 15, each shaft's circular arc surface 26*c* of the anti-slip member 26 may have a plurality of recesses 26*e*. Furthermore, the recess 26*e* does not have to have a vertically elongated shape but may also have any other arbitrary shape.

Note that each embodiment described above is just an example in any respect and should not be construed to be a limiting one. Besides, any variations or modifications falling within the range of equivalents to the claims to be described below are all encompassed within the scope of the present disclosure.

As can be seen from the foregoing description, a fan attachment structure according to the present disclosure is applicable to a blower unit for a vehicle air conditioner, for example.

What is claimed is:

1. A fan attachment structure for attaching a fan to an output shaft of a fan drive motor, wherein the fan includes: a fan body made of a resin and including impellers and a central cylindrical portion provided at a center of rotation thereof; and a cylindrical anti-slip member configured to be secured to the fan body by being inserted into the central cylindrical portion and to rotate integrally with the fan body, the anti-slip member having been injection-molded out of a resin, the output shaft is configured as a round bar and fitted into the anti-slip member so as to rotate integrally with the anti-slip member, the anti-slip member has a recess on an outer peripheral surface of the anti-slip member to make stress to be generated on the anti-slip member by the output shaft fitted non-uniform around a periphery of the anti-slip member, and also has a high-stress-generating portion and a low-stress-generating portion where the stress generated is lower than in the high-stress-generating portion, the anti-slip member has a flat surface in a portion, except the recess, of the outer peripheral surface of the anti-slip member, the flat surface extending along a centerline of the anti-slip member, the portion in which the flat surface is formed serving as the low-stress-generating portion, an inner peripheral surface of the central cylindrical portion has a flat surface, extending along a centerline of the central cylindrical portion, in a portion facing the flat surface of the anti-slip member, and a gap is formed between the flat surface of the central cylindrical portion and the flat surface of the anti-slip member, and while the anti-slip member is being molded, a weld line is formed in the portion, of the anti-slip member, in which the flat surface is formed.

* * * * *